US006070585A

United States Patent [19]

Fery et al.

[11] Patent Number: 6,070,585

[45] Date of Patent: Jun. 6, 2000

[54] SUPPORT DEVICE FOR BABY WITH ABDOMINAL PAIN AND METHOD FOR USING IT

[75] Inventors: Wendy Fery, 22186 SW. Mandan Dr., Tualatin, Oreg. 97062; Gregory T. Kavounas, Beaverton, Oreg.

[73] Assignee: Wendy Fery, Tualatin, Oreg.

[21] Appl. No.: 09/123,583

[22] Filed: Jul. 28, 1998

[51] Int. Cl.[7] ..... A61G 7/00

[52] U.S. Cl. ..... 128/845; 128/846; 5/630; 5/655

[58] Field of Search ..... 128/845, 846, 128/869, 870, 876; 5/630, 632, 655

[56] References Cited

U.S. PATENT DOCUMENTS

| | | | |
|---|---|---|---|
| 5,127,422 | 7/1992 | Colón | 128/870 |
| 5,233,714 | 8/1993 | De Bell Daniel | 128/876 |
| 5,331,699 | 7/1994 | Patton | 128/876 |
| 5,518,009 | 5/1996 | Ruiz-Gonzalez | 128/876 |

*Primary Examiner*—Michael A. Brown
*Attorney, Agent, or Firm*—Marger, Johnson & McCollom, P.C.

[57] ABSTRACT

A device is provided for supporting thereon a baby when it has gas pains, and a method for using the device. The support device has a main body with a top surface and a bottom surface opposite each other. It is placed by the bottom surface on a fixed surface. The bottom surface is shaped suitably for rocking against the fixed surface without slipping or transmitting vibration. The baby is placed faced down on the top surface of the support device. The top surface is shaped suitably so that it compresses the baby's abdomen at least in part, and thus facilitates the escape of gas that causes the pain. A fabric placed on the top surface increases the baby's comfort, with a heating pad under it. If the main body is ball shaped, knobs prevent tipping over, and straps secure the baby from sliding off the top surface. The bottom surface is preferably flatter than the top surface, which eliminates the need for knobs. The top surface can be specially shaped to hold the baby without the risk of sliding off, which eliminates the need for straps. The method of the invention is to find a fixed surface, optionally place a vibration quieting mat on it, procure a support device, place the device on the fixed surface, place the baby face down on the device and strap it on there, and then rock gently the device.

20 Claims, 2 Drawing Sheets

SUPPORT DEVICE FOR BABY WITH ABDOMINAL PAIN AND METHOD FOR USING IT

BACKGROUND OF THE INVENTION

1. Field of the Invention

The present invention is related to the field of care for babies, and more specifically to devices for supporting babies such that their abdominal pains are alleviated, and methods for using such devices.

2. Description of the Related Art

When a baby experiences abdominal pains, it is recommended to hold it specially so as to apply gentle pressure to the abdomen for a period of time. It is also recommended to rock the baby gently at that time.

Such special holding is uncomfortable to the care giver. Uncomfortable holding and rocking may tire the care giver, who may thus be forced to abandon the effort before the baby experiences relief. If this happens, the discomfort of the baby continues, and the special holding and rocking was for nothing.

BRIEF SUMMARY OF THE INVENTION

The present invention overcomes these problems and limitations of the prior art.

Generally, the present invention provides a device for supporting thereon a baby when it has gas pains, and a method for using it. The support device has a main body with a top surface and a bottom surface opposite each other. The support device is placed on a fixed surface by the bottom surface. The bottom surface is shaped suitably for rocking against the fixed surface without slipping or transmitting vibration.

The baby is placed faced down on the top surface of the support device. The top surface is shaped suitably so that it compresses the baby's abdomen at least in part, and thus facilitates the escape of gas that causes the pain. A fabric placed on the top surface increases the baby's comfort.

In an apparatus according to a first embodiment of the present invention, the main body is ball shaped. Knobs prevent tipping over, and straps secure the baby from sliding off the top surface.

In an apparatus according to a second embodiment of the present invention, the bottom surface is spherical but much flatter than the top surface. This eliminates the risk of tipping over, and thus eliminates the need for knobs.

In an apparatus according to a third embodiment of the present invention, the top surface is specially shaped to bold the baby low, close to the fixed surface and without the risk of sliding off the top surface. As such, the need for straps is eliminated.

The method of the invention is to find a fixed surface, optionally place a vibration quieting mat on it, procure a support device, place the device on the fixed surface, place the baby face down on the device and strap it on there, and then rock gently the device. The method of the invention is not tiring to the care giver, who can thus maintain rocking long enough until the baby experiences relief.

This and other features and advantages of the present invention will become apparent and more appreciated after consideration of the Drawing(s) and Detailed Description of the Preferred Embodiment(s) of the invention.

DETAILED DESCRIPTION OF THE PREFERRED EMBODIMENT(S) OF THE INVENTION

As has been mentioned, the present invention provides a device for supporting thereon a baby when it has gas pains (a.k.a. "colic"). The first and second embodiments are now described with reference to FIGS. 1 and 2 respectively.

Figure 1:
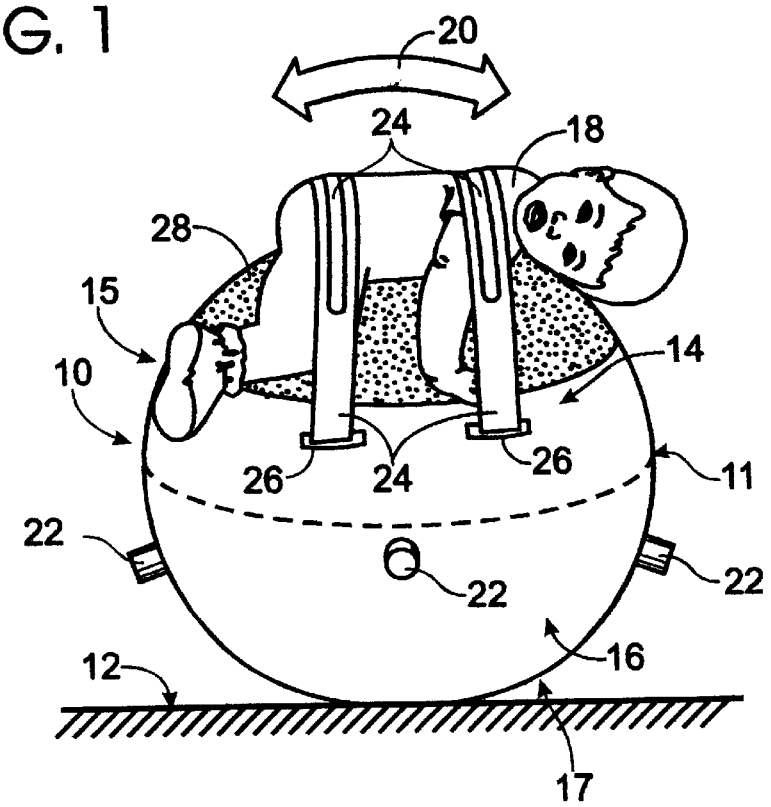
FIG. 1 illustrates a combination of a fixed surface and a support device made according to the first embodiment of the present invention.

Referring particularly to FIG. 1, a support device 10 made according to the invention rests on a resilient fixed surface 12. In fact the invention is best considered as a combination of the support device and the resilient fixed surface. This is for a variety of reasons having to do with the stability of the support device on the fixed surface. This is where considerations of the geometry of the combination come in, etc.

When it is said that surface 12 is fixed, it is meant that the surface is not moving with respect to its immediate surroundings excepting the support device. When it is said that surface 12 is resilient, it is meant regaining its shape after the support device has been placed on it. For example, to practice the present invention, resilient surface 12 can be the top of a counter, a bed, etc.

Support device 10 has a main body 11. The main body includes a top surface 14 and a bottom surface 16 opposite each other as shown. The top surface includes a convex portion 15. The top surface can be of a simple shape, in which case the entire top surface is convex. By "convex" in this document it is meant convex in at least one dimension, although it is preferably in two. As an example, the surface of a cylinder is convex in one dimension, while that of a sphere is convex in two dimensions.

Bottom surface 16 includes at least one resilient portion 17. It is preferred that the bottom surface is made from a single material, in which case the entire surface is resilient. Main body 11 is placed by bottom surface 16 on fixed surface 12. Placement is such that device 10 rests on the resilient fixed surface by the resilient portion 17 of the bottom surface. The main body is configured, shaped and sized to facilitate that.

Further, the resilient portion of bottom surface 16 is typically convex, to permit rocking of the support device against the fixed surface, as is described below. In fact, the entire bottom surface can be convex.

In general, surface 12 is flat, but it can be other shapes. It is possible that it is concave, to prevent the support device from rolling away on its own, etc.

Since both the top and bottom surfaces can be convex, it may be very economical to make the whole support device spherical, i.e. ball shaped. This would mean that the top and bottom surfaces would have the same radius of curvature, and coincident centers of curvature.

Baby 18 is placed face down on the top surface of the main body of the support device. By "face down" in this document it is meant on the stomach; the actual face of the baby can be turned to either side.) The baby is placed such that the abdomen is pressed against the convex portion of the top surface by the baby's own weight.

Preferably the baby is maintained entirely over top surface 14, which means that the baby does not contact the fixed surface 12. This is accomplished by the proper configuration, dimensions, and shape of the main body, plus proper placement of the baby on the top surface 14. This permits rocking of the support device against the fixed surface, which results in rocking the baby without friction of the baby against the surface.

The allowable range of safe rocking is represented by arc 20. Rocking past that runs the risk of tipping over, and thus should be avoided by the care giver. Arc 20 is short because the baby is maintained high above the fixed surface.

Optionally and preferably, the main body includes tipping prevention structure 22. This prevents the support device from tipping over, especially if it is shaped like a ball. The preferred tipping prevention structure is a plurality of knobs 22. A person skilled in the art will readily determine their preferred placement and optimum shape.

In addition, fixed surface 12 and bottom surface 16 are configured to have a high friction coefficient between them. This is accomplished by a layer of foamy material attached to the bottom surface. This also quiets vibrations induced by rocking that could reach the baby through the main body. Alternately, a vibration quieting mat can be placed on the fixed surface, that preferably has a high coefficient of friction.

Optionally and preferably the support device of the invention further comprises at least one strap for strapping the baby on the top surface. In the preferred embodiment, it comprises four straps 24 attached to the main body. The straps are made from cloth, elastic material, leather, or other suitable material.

The support device of the invention further comprises strap fastening means. The strap fastening means are used to secure the strap or straps around the baby. This way the baby will not slide off the convex top surface. The strap fastening means are chosen in view of what the straps are made of. They can be buckles, or whatever can secure the straps. The simplest embodiment is with velcro, that attaches together reciprocating straps. Velcro is also quick to attach, and automatically adjusts for any size baby.

The straps are attached to the support device by anchors 26 attached to the main body. The anchors are made from suitable materials in view of what materials the main body and the straps are made of.

Optionally and preferably the support device of the invention further comprises a fabric 28 intended to increase the baby's comfort. Fabric 28 is made from suitable material such as a blanket or mattress lining or equivalent. The fabric is securable onto top surface 14 by suitable means that are attached to the main body. The means can be fasteners at the edges of the fabric, such as buttons (not shown separately). The fabric is removable from the top surface for cleaning.

Optionally and preferably the support device of the invention further comprises a heating pad, which is also known as a warm pack and warm pad. The heating pad is not seen in FIG. 1 because it is under fabric 28.

Main body 11 is made from any suitable means, such as an inflatable plastic bag or ball. Alternately it can be made from plastic, styrofoam, or equivalent materials.

Figure 2:
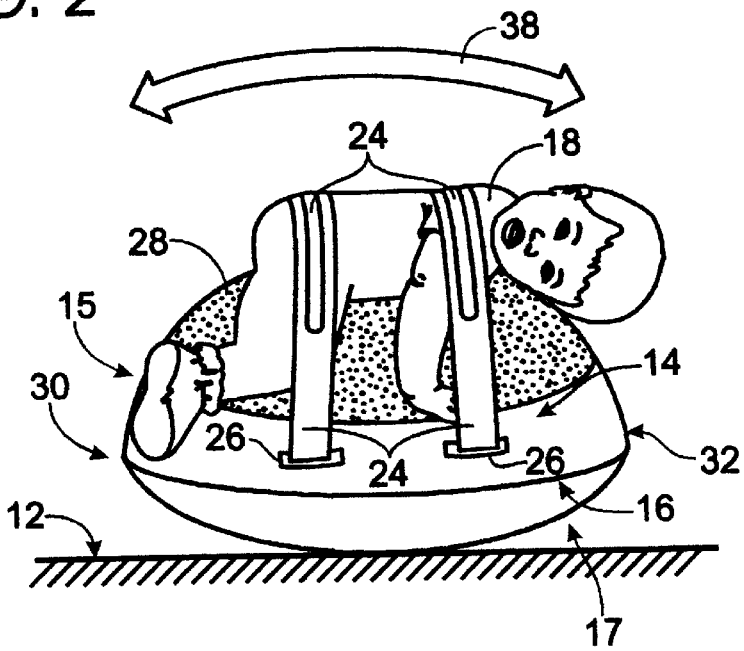
FIG. 2 illustrates a combination of a fixed surface and a support device made according to the second embodiment of the present invention.

Referring to FIG. 2, the second embodiment of the present invention is now described. A support device 30 made according to the invention is shown as having a main body 32 and many features with similar reference numbers to corresponding features of device 10 of FIG. 1. This was done where the features are the same. In fact, support device 30 differs from device 10 only in the following ways:

First, bottom surface 36, with its resilient portion 37 is much flatter. This lowers substantially the center of gravity of the combination of the baby and the support device. Therefore, the second embodiment reduces substantially the risk of tipping over, which is a reason why the second embodiment is preferred to the first. This is also reflected by arc 38 being longer than arc 20. Accordingly, another difference is that knobs (such as knobs 22 of FIG. 1) are not provided on main body 32, because they are not needed.

Thus, a key characteristic of the second embodiment is that top surface 14 has a necessarily different shape than bottom surface 36. In the embodiment of FIG. 2 both surfaces are spherical. However, the bottom surface has a larger radius of curvature, and their centers of curvature do not coincide.

Further the requirement for a high coefficient of friction is eliminated. Then the vibration quieting mat need not have a high coefficient of friction, and can be implemented by a mere towel, napkin or blanket.

Figure 3:
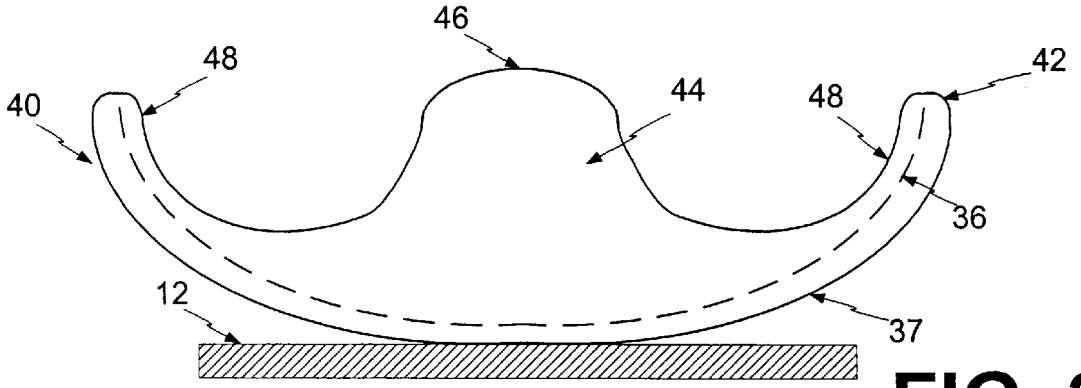
FIG. 3 is a cross section of a support device made according to the third embodiment of the invention.

The third embodiment of the present invention is now described with reference to FIG. 3. Support device 40 has a main body 42 that is substantially circularly symmetric. The main body need not be circularly symmetric—it can be more tailor made to the contour of the baby's body). The surfaces are now described in more detail. Indeed, each surface performs a different function.

The bottom surface is shaped for facile rocking, and without changing too much the elevation of the baby at the extremes of the arc. For this, a rigid surface with a large radius of curvature (slow "elevation change") is indicated. Surface 36 (same as for support device 30 of FIG. 2) would do well.

Further, if the main body is shaped to accept the baby in a specific orientation, and if it is determined that rocking in one direction is more effective than others in alleviating gas pains, then the bottom surface can be implemented so as to permit rocking only in the optimum direction. This would be accomplished by shaping the bottom surface to be convex in only one dimension.

Top surface 44 should be shaped so as to more suitably press into the baby's abdomen. This calls for a convex portion 46 that is hill shaped at the place corresponding to the baby's abdomen. This place is somewhat off center from the geometric center of the main body of the support device 40.

However, the top surface need not be convex everywhere, only at a portion. Indeed, it can have a lip 48 around convex portion 46. The lip helps keep the baby entirely on the support device, while also low (i.e. not elevated too much from the fixed surface 12). Therefore this design eliminates the need for straps, although straps may still be used with this embodiment. Further, the top surface need not be rigid, although a fabric (not shown) can be thick enough to compensate even for a rigid surface.

For these reasons, the third embodiment is preferred to the second. However, the second embodiment is preferred for other reasons, such as it can be implemented more inexpensively with inflatable means, etc.

The person skilled in the art will readily discern ways of making support device 40. Because of its small size and volume, plastic molding works well.

Figure 4:
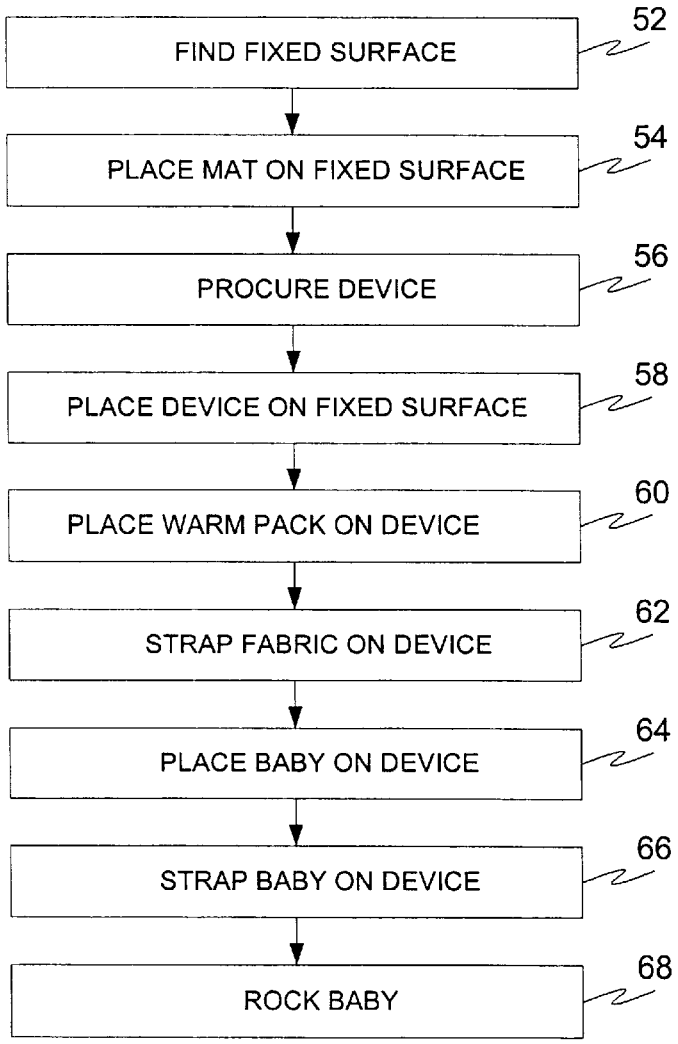
FIG. 4 is a flowchart illustrating a method according to the present invention.

A method of the present invention is now described with reference to FIG. 4. The method is for alleviating pain in the abdomen of a baby. The method comprises the steps described below. It will be apparent that these steps need not be performed exactly in the order shown. For example, the baby can be strapped to the support device first, and then the device be placed on the fixed surface, etc. In detail, the steps are as follows:

Referring to step 52, a fixed surface is found meeting the requirements of surface 12 described above.

Referring to step 54, a vibration quieting mat is optionally placed on the fixed surface. The mat is as described above, and optionally has a high coefficient of friction on both sides.

Referring to step 56, a support device made according to the present invention is procured.

Referring to step 58, the bottom surface of the main body is placed on the fixed surface. This is done in such a way that the main body is caused to rest on the fixed surface by the resilient portion of the bottom surface.

Referring to step 60, a heating pad is placed on the top surface. The heating pad is preferably turned on the lowest setting.

Referring to step 62, a fabric is placed on the top surface, preferably on the heating pad.

Referring to step 64, the baby is placed on the top surface of the main body. Placement is such that the baby's abdomen is pressed or compressed at least in part against the convex portion of the top surface by the baby's own weight. Further, it is preferred that placement is such that the baby is balanced on the support device without contacting the fixed surface.

Referring to step 66, if the support device is provided with straps and strap fastening means, the straps are secured around the baby using the strap fastening means.

Referring to step 68, the baby is rocked against the fixed surface, i.e. moved with respect to it. This is accomplished by rocking the support device against the fixed surface, or by rocking directly the baby, or both. Rocking is better if the baby has been placed on the support device such that it does not contact the fixed surface.

In the present description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention. Again, one skilled in the art will appreciate that it is possible to make various modifications, additions and substitutions to the present description without departing from the scope and spirit of the invention as claimed in the accompanying claims.

The invention claimed is:

1. A combination for alleviating pain in the abdomen of a baby comprising a resilient fixed surface and a support device that comprises:

a main body including a bottom surface that includes a resilient portion and a top surface that is opposite the bottom surface and includes a convex portion;

at least one strap; and strap fastening means, the main body placed by the bottom surface on the fixed surface such that it rests on the fixed surface by the resilient portion of the bottom surface, the baby placed face down on the top surface of the main body such that the abdomen of the baby is pressed at least in part against the convex portion of the top surface by the baby's weight, the strap secured around the baby using the strap fastening means.

2. The combination of claim 1, wherein the main body is spherical.

3. The combination of claim 1, wherein the support device further comprises a fabric that is removably securable onto the top surface of the main body.

4. The combination of claim 1, wherein the support device further comprises a heating pad under the baby and over the convex portion of the top surface.

5. The combination of claim 1, wherein the fixed surface is flat, the resilient portion of the bottom surface is convex, and the main body includes tipping prevention structure.

6. The combination of claim 5, wherein the support device further comprises a fabric that is removably securable onto the top surface of the main body.

7. A combination for alleviating pain in the abdomen of a baby comprising a resilient fixed surface and a support device that comprises:

a main body including a bottom surface that includes a resilient portion and a top surface that is opposite the bottom surface and includes a convex portion, the top surface having a different shape than the bottom surface, the support device placed by the bottom surface on the fixed surface such that it rests on the fixed surface by the resilient portion of the bottom surface, the baby placed face down on the top surface of the main body such that the abdomen of the baby is pressed at least in part against the convex portion of the top surface by the baby's weight.

8. The combination of claim 7, wherein the support device further comprises a fabric that is removably securable onto the top surface of the main body.

9. The combination of claim 7, wherein the support device further comprises at least one strap and strap fastening means, the strap secured around the baby using the strap fastening means.

10. The combination of claim 7, wherein the support device further comprises a heating pad under the baby and over the convex portion of the top surface.

11. A method for alleviating pain in the abdomen of a baby comprising the steps of:

procuring a support device having a top surface and a bottom surface opposite each other, the top surface including a convex portion, the bottom surface including a resilient portion, the support device further having strap fastening means and at least one strap;

placing the main body of the support device on a resilient fixed surface by the bottom surface, thereby causing the main body to rest on the fixed surface by the resilient portion of the bottom surface;

placing the baby face down on the top surface of the main body such that the baby's abdomen is pressed at least in part against the convex portion of the top surface by the baby's own weight; and using the strap fastening means to secure the strap around the baby.

12. The method of claim 11 further comprising the step of placing a mat between the fixed surface and the support device.

13. The method of claim 11 further comprising the step of rocking the baby against the fixed surface.

14. The method of claim 11 further comprising the step of placing a heating pad on the device.

15. A method for alleviating pain in the abdomen of a baby comprising the steps of:

procuring a support device having a main body that includes a top surface and a bottom surface opposite each other, the two surfaces having a different shape from each other, the top surface including a convex portion, the bottom surface including a resilient portion;

placing the main body of the support device on a resilient fixed surface by the bottom surface, thereby causing the main body to rest on the fixed surface by the resilient portion of the bottom surface; and placing the baby face down on the top surface of the main body such that the baby's abdomen is pressed at least in part against the convex portion of the top surface by the baby's own weight.

16. The method of claim 15 further comprising the step of placing a heating pad on the device.

17. The method of claim 15 further comprising the step of rocking the baby against the fixed surface.

18. The method of claim 15 further comprising the step of placing a mat between the fixed surface and the support device.

19. The method of claim 15, wherein the support device further comprises strap fastening means and at least one strap, and the method further comprises the step of using the strap fastening means to secure the strap around the baby.

20. The method of claim 19 further comprising the step of rocking the baby against the fixed surface.

* * * * *